United States Patent [19]

Roden et al.

[11] Patent Number: 4,939,808

[45] Date of Patent: Jul. 10, 1990

[54] CARPET CLEANING APPARATUS

[75] Inventors: James R. Roden, Phoenix, Ariz.; Gary D. Ingle, Mound, Minn.

[73] Assignee: Professional Chemicals Corporation, Chandler, Ariz.

[21] Appl. No.: 468,177

[22] Filed: Jan. 22, 1990

[51] Int. Cl.[5] ..... A47L 11/30

[52] U.S. Cl. ..... 15/322; 15/379; 15/380

[58] Field of Search ..... 15/320, 321, 322, 379, 15/380

[56] References Cited

U.S. PATENT DOCUMENTS

| | | | |
|---|---|---|---|
| 1,766,425 | 6/1930 | Brockway | 15/379 X |
| 3,040,366 | 6/1962 | Vance | 15/379 X |
| 3,688,338 | 9/1972 | Lundvall | 15/364 |
| 3,974,541 | 8/1976 | Silvis et al. | 15/320 |
| 4,037,290 | 7/1977 | Rose et al. | 15/345 |
| 4,095,309 | 6/1978 | Sundheim | 15/320 |
| 4,156,952 | 6/1979 | Lynch | 15/322 X |
| 4,272,861 | 5/1981 | Notta et al. | 15/322 X |
| 4,649,594 | 3/1987 | Grave | 15/322 |

OTHER PUBLICATIONS

Brochure—"RX-20 Rotary Jet Extration System" by HydraMaster Corporation—no date.

*Primary Examiner*—Chris K. Moore

*Attorney, Agent, or Firm*—Cahill, Sutton & Thomas

[57] ABSTRACT

Multiple side-by-side vacuum nozzles are reciprocated along paths of travel parallel to the preferred path of travel of carpet cleaning apparatus. The vacuum nozzles are propelled through a drive mechanism which moves each vacuum nozzle out of phase with the movement of every other nozzle. Cleaning fluid discharge members associated and movable with each vacuum nozzle direct cleaning fluid onto the carpet adjacent their respective vacuum nozzles.

10 Claims, 2 Drawing Sheets

CARPET CLEANING APPARATUS

TECHNICAL FIELD

This invention is concerned with apparatus for cleaning carpets by injecting a cleaning fluid into the carpet and vacuuming away the cleaning fluid and loosened dirt.

BACKGROUND ART

It has been customary for some time to clean carpets by spraying a cleaning fluid, usually a warm solution of detergent and water, onto a narrow strip of the carpet and immediately thereafter vacuuming the strip to carry away the liquid and the loosened dirt. The cleaning fluid spray nozzle has usually been mounted on or closely associated with the vacuum nozzle in a wand or housing which is drawn across the carpet toward the operator. Examples of apparatus employing this technique are disclosed in U.S. Pat. Nos. 3,974,541, granted Aug. 17, 1976 to Donahue B. Silvis and Edward A. Vargas, for "APPARATUS FOR CLEANING A FLOOR" and No. 4,649,594, granted Mar. 17, 1987 to Dale L. Grave, for "CLEANING HEAD FOR SMOOTH AND NAPPED SURFACE COVERING MATERIALS".

Carpet cleaning apparatus of the aforementioned type usually are capable of cleaning only a narrow strip of carpet on each pass so cleaning with them is time consuming. Furthermore, because the movement of the vacuum nozzle is unidirectional, there is a tendency for the apparatus to mat down the wet carpet nap trapping dirt therein. This simply means that the apparatus does not clean the carpet as thoroughly as is desired.

Hydra Master Corporation of West Lynnwood, Washington produced and sold an RX-20 Rotary Jet Extraction System in which five cleaning heads, each with a spray jet and a vacuum head, were mounted for rotary motion in a housing. This apparatus not only matted the carpet but also subjected the carpet to excessive wear during cleaning.

James J. Rose and Edward L. Horton in their U.S. Pat. No. 4,037,290, granted July 26, 1977 for "VACUUM CLEANING DEVICE" proposed to loosen and remove soil from the carpet simply by directing a rotating jet of high pressure air into the carpet beneath a movable vacuum chamber. So far as is known, the invention disclosed in that patent never enjoyed any commercial success.

As early as 1930, Carl P. Brockway proposed in his U.S. Pat. No. 1,766,425, for "VACUUM SWEEPER" that the vacuum nozzle of a conventional vacuum cleaner be oscillated in a forward and backward direction. His objective was to cause the threads of the fabric to vibrate more or less rapidly to loosen and dislodge dirt particles.

U.S. Pat. No. 4,095,309, granted June 20, 1978 to John J. Sundheim for "APPARATUS FOR CLEANING A CARPET" suggested reciprocating a single cleaning head (comprising spray nozzles and a vacuum nozzle) in relation to the body of the apparatus. This apparatus has the obvious disadvantage of exhibiting severe imbalance in operation. The inventor sought to employ the unbalanced jerking motion of his components to propel the apparatus over the carpet. As a result, the movement of the cleaning head relative to the carpet was essentially unidirectional, albeit intermittent, offering the same tendency to mat the carpet nap.

There continues to be a need for truly effective carpet cleaning apparatus.

DISCLOSURE OF THE INVENTION

This invention envisions carpet cleaning apparatus in which a plurality (at least two) of vacuum nozzles are disposed side-by-side and mounted for reciprocating movement along paths generally parallel to the preferred path of travel of the apparatus. The drive for the multiple nozzles propel the nozzles in such a manner that the movement of each nozzle is out of phase with the movement of every other nozzle. The apparatus includes cleaning fluid discharge means capable of directing cleaning fluid into the carpet in close proximity to the inlet of the vacuum nozzles.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
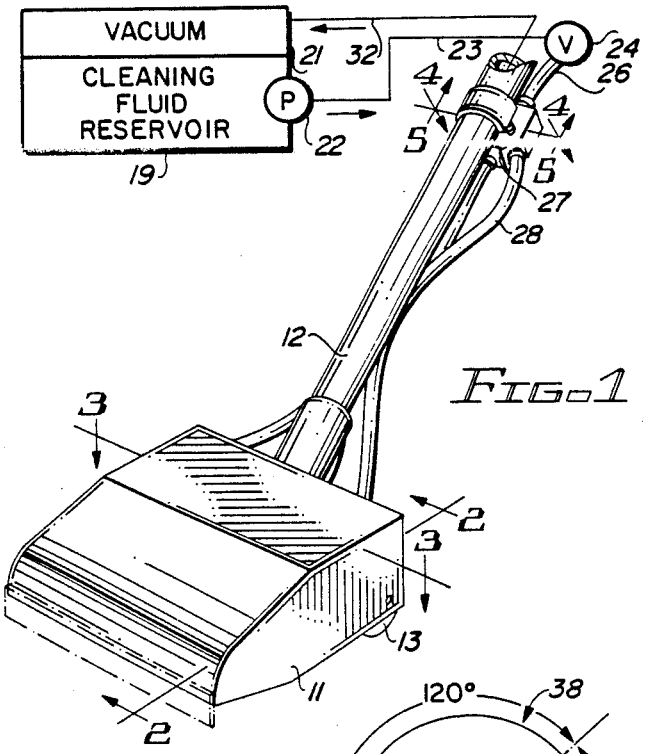
FIG. 1 is a three-quarter perspective view of carpet cleaning apparatus embodying this invention. Certain auxiliary equipment associated with the apparatus is illustrated diagrammatically.
Figure 4:
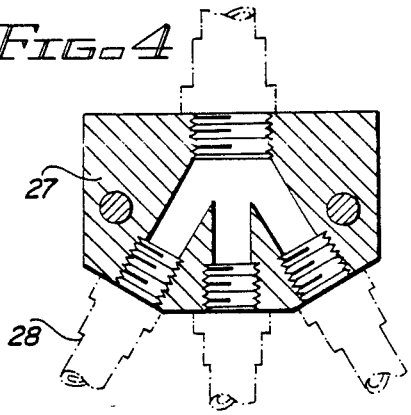
FIG. 4 is a sectional view through a cleaning fluid manifold taken generally as indicated by line 4—4 in FIG. 1.

Referring particularly to FIG. 1, the numeral 11 designates a housing for the carpet cleaning apparatus of this invention. Projecting rearwardly and upwardly from housing 11 is a hollow handle 12 which is employed to push and pull the housing 11 across the carpet surface. As will be seen later on, the hollow handle 12 may also function as a conduit for air, cleaning fluid and dirt extracted from the carpet. The preferred path of movement for the housing 11 generally is a straight line along the fore and aft centerline of the housing.

A significant portion of the weight of the housing 11, its contents, and handle 12 is carried by a pair of wheels 13 mounted in a rear portion of the housing. The forward portion of housing 11 rests on a series of vacuum nozzles 14 mounted side-by-side in housing 11 and projecting downwardly through an opening 15 in the bottom of the housing. The lower ends of the vacuum nozzles 14 contact the surface of the carpet 16 being cleaned.

Each vacuum nozzle 14 constitutes one component of a cleaning head 17 which also includes cleaning fluid discharge means which may take the form of a discharge nozzle 18. Each vacuum nozzle 14 thus has a discharge nozzle 18 associated therewith. Cleaning fluid, which may be a liquid solution of water and detergent or simply air under pressure, is sprayed from each discharge nozzle and injected into the carpet 16 to loosen dirt in the carpet and to function as a carrier vehicle for removal of that dirt.

Each discharge nozzle sprays cleaning fluid into a region of the carpet in close proximity to its respective vacuum nozzle 14. Cleaning of the carpet 16 is effected by moving a vacuum nozzle 14 over a region of the carpet sprayed with cleaning fluid to draw dirt and cleaning fluid out of the carpet and into the vacuum nozzle. This basic principle of carpet cleaning is the same as is employed in a number of the prior patented cleaning apparatus identified above, but, as will be seen from a further portion of this description of the invention, superior cleaning is achieved as a result of manipulation of the vacuum nozzles 14.

Figure 5:
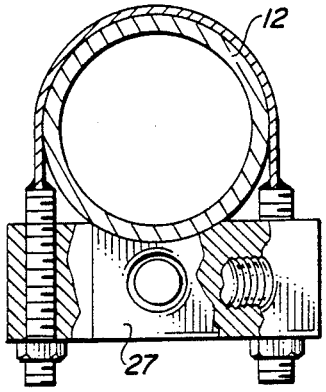
FIG. 5 is another sectional view through the cleaning fluid manifold taken generally as indicated by line 5—5 in FIG. 1.

Auxiliary equipment required for operation of the cleaning apparatus is illustrated diagrammatically in FIG. 1. This equipment includes a cleaning fluid reservoir 19 and a vacuum source 21. A pump 22 associated with the cleaning fluid reservoir 19 supplies cleaning fluid via a hose 23 to a valve 24 preferably mounted on the hand grip (not shown) of handle 12. Cleaning fluid supplied when valve 24 is opened passes through a supply line 26 to a manifold 27. Manifold 27 is preferably clamped to handle 12 in the manner shown in FIGS. 1 and 5 and its purpose is to supply equal quantities of cleaning fluid to three feed hoses 28 connected respectively to the three discharge nozzles 18 on the three cleaning heads 17. Each feed hose is flexible to permit movement of the cleaning heads 17.

Figure 6:
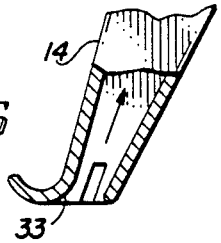
FIG. 6 is an enlarged fragmentary view of the inlet region of a vacuum nozzle employed in the invention; the enlarged area is indicated by circle 6 in FIG. 2.

A vacuum must be applied to the moving vacuum nozzles 14 and the circuit for accomplishing this includes a length of flexible hose 29 connected to each vacuum nozzle 14. Each vacuum hose 29 has its opposite end connected to a vacuum manifold 31 disposed in housing 11 and communicating with the hollow interior of handle 12. Handle 12 is, in turn, in communication with a vacuum hose 32 connected to the vacuum source 21. Vacuum manifold 31 serves to ensure the application of equal vacuum to each of the three vacuum nozzles 14. In accordance with this invention, each vacuum nozzle 14 is reciprocated along a path of travel which is parallel to the preferred path of travel of the housing 11 as it is pulled or pushed over the carpet 16. This motion of the vacuum nozzles is along a path which is normal to the elongated entry opening 33 at the lower end of each nozzle (see FIG. 6). The three side-by-side nozzles 14 are thus capable of cleaning substantially wide swaths of carpet.

Figure 3:
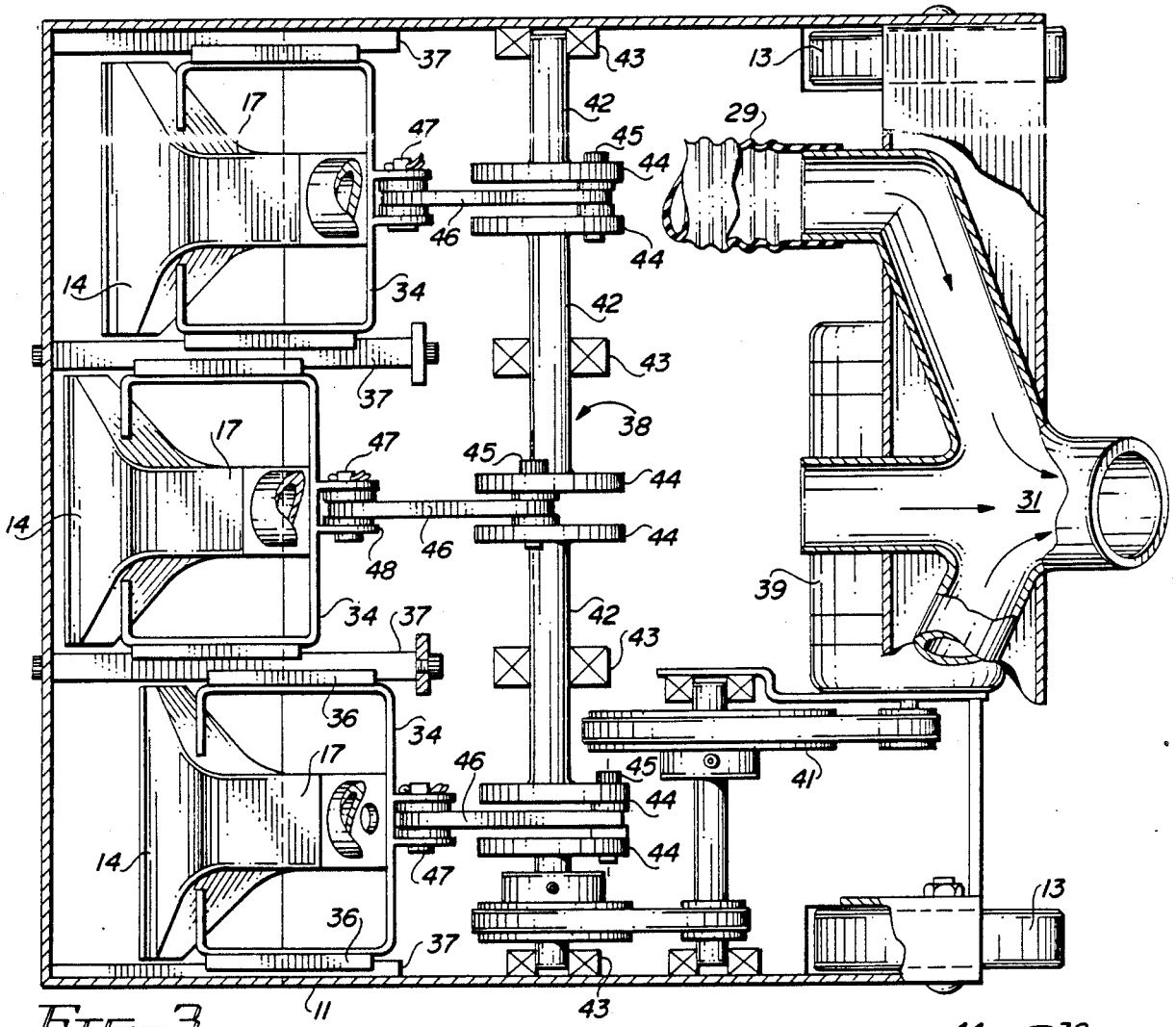
FIG. 3 is a horizontal sectional view through the housing taken generally as indicated by line 3—3 in FIG. 1.
Figure 7:
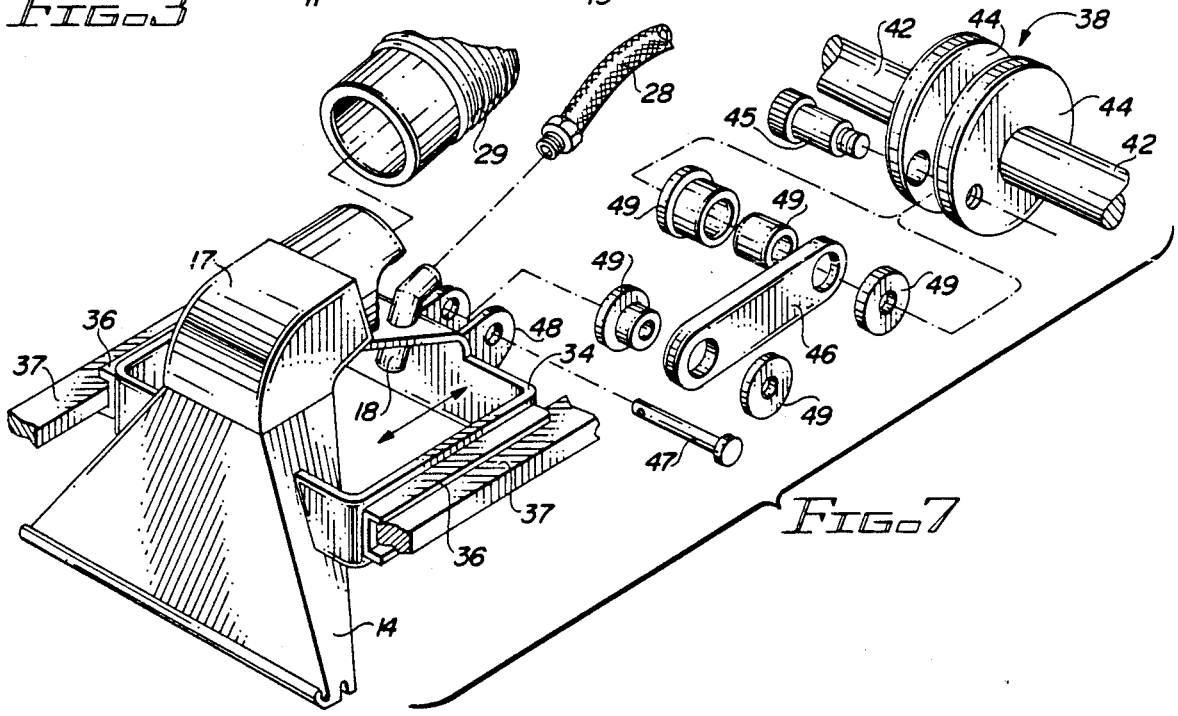
FIG. 7 is an enlarged exploded perspective view of a vacuum nozzle and a portion of the drive mechanism therefor.

The nozzles 14 are preferably mounted within housing 11 in a manner to minimize the spaces therebetween. A preferred mounting arrangement is illustrated in FIGS. 3 and 7. Each cleaning head 17 includes a yoke 34 which supports a pair of oppositely disposed slide rails 36. Each slide rail has a C-shaped cross-section adapted to receive an elongated rectangular bearing block 37.

A non-corrosive mounting arrangement permitting free reciprocating movement of vacuum nozzles 14 can be provided by forming the slide rails 36 of stainless steel or aluminum sheet metal and the bearing blocks 37 of an unctuous plastic material such as nylon, polytetrafluoroethylene or high density polyethylene.

Reciprocation of the vacuum nozzles 14 is effected by a crankshaft 38 transversely disposed in housing 11 and driven by an electric motor 39 through a belt and pulley reduction chain 41. Crankshaft 38 includes a plurality of shaft segments 42 supported by bearings 43 and connected by disc-like crank members 44 and connector pins 45.

Crankshaft 38 propels vacuum nozzles 14 through a series of connecting rods 46. Each connecting rod 46 is pivotally attached at one end to a connector pin 45 and at its other end to a yoke 34 on its cleaning head 17. A head pin 47 passing through trunnions 48 on each yoke 34 and through the connecting rod fasten each rod to its respective cleaning head. If desired, plastic bearing components 49 can be provided for the connections at the ends of the connecting rod 46.

Figure 8:
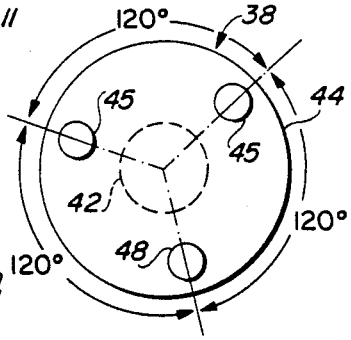
FIG. 8 is a diagrammatic illustration of crankshaft connections employed in the drive mechanism of the apparatus.
Figure 2:
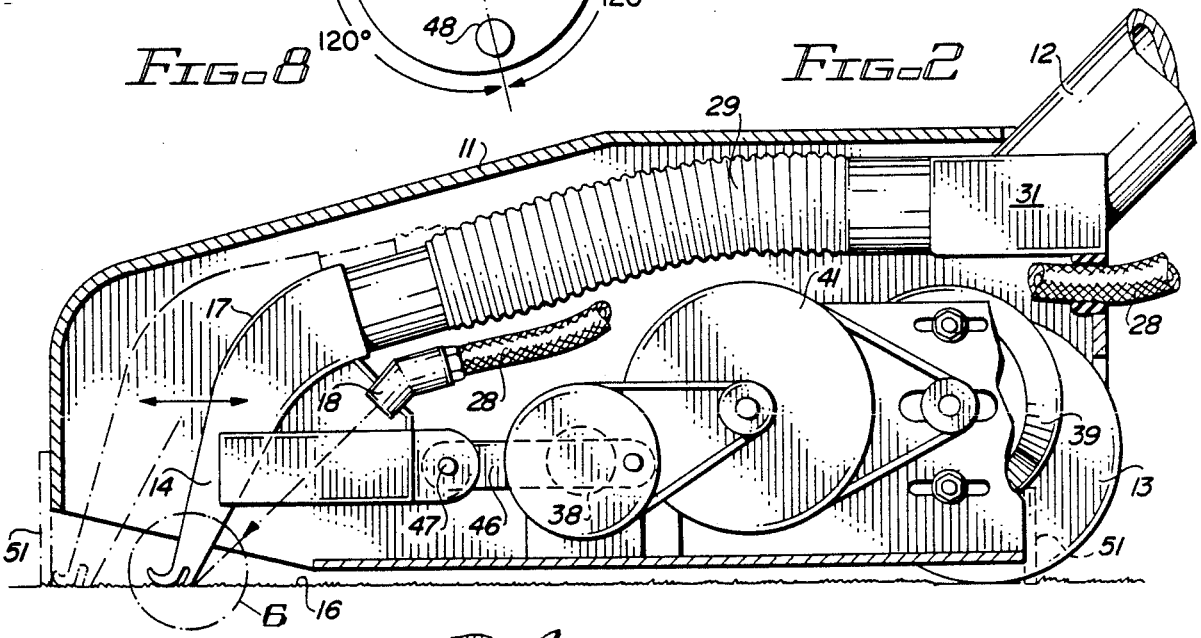
FIG. 2 is an enlarged vertical sectional view through the apparatus housing taken generally as indicated by line 2—2 in FIG. 1.

Ideally, the cleaning apparatus should operate in a balanced, substantially vibration-free, condition with all three cleaning heads 17 moving simultaneously. This condition is achieved by causing each cleaning head 17 to move out of phase with each of the other cleaning heads. This is accomplished by displacing the connector pin connections 45 in the crankshaft 38 equidistant around the crankshaft. FIG. 8 diagrammatically illustrates this relative displacement of the three connector pins 45 on their respective crank members 44.

From the foregoing, it should be apparent that apparatus provided by this invention is capable of subjecting a fairly wide swath of carpet to rapidly reciprocating vacuum cleaning of areas which have previously been injected with cleaning fluid. Each vacuum nozzle 14 preferably moves with a stroke of from 1 to 1.5 inches at a speed of from 120 to 600 to-and-from strokes per minute. The action of the moving vacuum nozzles 14 on cleaning head 17 fan the carpet nap back and forth to assist the vacuum flow of cleaning fluid to loosen dirt without flattening and matting down the nap. More thorough and efficient cleaning of the carpet is the result.

As mentioned previously, the cleaning fluid injected into the carpet may simply be air discharged from the discharge nozzle 18 under pressure. This air enters the carpet nap at a high speed and with sufficient force to loosen and dislodge dirt which can then be carried away in the vacuum airstream through vacuum nozzles 14. The tendency for dirt thus loosened to blow out from the apparatus and to the surrounding atmosphere can be reduced by equipping the housing with a depending shroud, or skirt, 51. The skirt is made from a flexible material, such as sheet rubber, to gently contact the surface of the carpet and seal off the area of the carpet beneath the apparatus housing 11.

It is also to be noted that in the preferred embodiment of the invention described above, the fluid discharge nozzles 18 are associated with their respective vacuum nozzles 14 by mounting them on the yoke portions 34 of the cleaning heads 17 behind the vacuum nozzles for movement therewith. An alternative arrangement might include mounting each discharge nozzle 18 on its cleaning head 17 ahead of its vacuum nozzle 14. In another arrangement, the association might be provided by stationarily mounting one or more discharge nozzles within housing 11 in the vicinity of the vacuum nozzles 14, either immediately ahead or immediately behind the vacuum nozzles.

What is claimed is:

1. Carpet cleaning apparatus adapted to be moved across a carpet along a preferred path of travel, first and second vacuum nozzles having elongated inlet openings extending substantially normal to said preferred path of travel, means supporting said first and second vacuum nozzles for reciprocating movement along paths substantially parallel to said preferred path of travel, means for propelling said vacuum nozzles along their paths with the movement of said vacuum nozzles being out of phase with each other, and cleaning fluid discharge means associated with said vacuum nozzles.

2. Carpet cleaning apparatus according to claim 1 further characterized in that there are cleaning fluid discharge means associated with each of said vacuum nozzles.

3. Carpet cleaning apparatus according to claim 2 further characterized in that said cleaning fluid discharge means are mounted on said vacuum nozzles for movement therewith.

4. Carpet cleaning apparatus according to claim 3 further comprising a fluid supply manifold adapted to be connected to a source of cleaning fluid, and flexible hose means connecting each of said discharge means to said fluid supply manifold.

5. Carpet cleaning apparatus according to claim 1 further comprising a third vacuum nozzle positioned alongside said second vacuum nozzle, said third vacuum nozzle having an elongated inlet opening extending substantially normal to said preferred path of travel, means for supporting said third vacuum nozzle for reciprocating movement along a path substantially parallel to said preferred path of travel, cleaning fluid discharge means associated with said third vacuum nozzle, and means for propelling all of the vacuum nozzles with the movement of each vacuum nozzle being out of phase with respect to the movement of each of the other two vacuum nozzles.

6. Carpet cleaning apparatus according to claim 5 further characterized in that said cleaning fluid discharge means are mounted on said vacuum nozzles for movement therewith.

7. Carpet cleaning apparatus according to claim 5 further comprising a vacuum manifold adapted to be connected to a source of vacuum, and flexible hose means connecting each of said vacuum nozzles to said vacuum manifold.

8. Carpet cleaning apparatus according to claim 7 further comprising a fluid supply manifold adapted to be connected to a source of cleaning fluid, and flexible hose means connecting each of said discharge means to said fluid supply manifold.

9. Carpet cleaning apparatus according to claim 1 wherein said propelling means comprises a crankshaft having an axis of rotation disposed substantially perpendicular to said preferred path of travel, a connecting rod for each of said vacuum nozzles, each of said connecting rods being connected to said crankshaft, and motor means for rotating said crankshaft.

10. Carpet cleaning apparatus according to claim 1 further comprising a vacuum manifold adapted to be connected to a source of vacuum, and flexible hose means connecting each of said vacuum nozzles to said vacuum manifold.

* * * * *